US005429101A

United States Patent [19]

Uebelhoer et al.

[11] Patent Number: 5,429,101

[45] Date of Patent: Jul. 4, 1995

[54] OIL SEPARATOR FOR THE GASES OF THE CRANKCASE OF AN INTERNAL-COMBUSTION ENGINE

[75] Inventors: Bertram Uebelhoer, Korb; Heinz Wendt, Ludwigsburg, both of Germany

[73] Assignee: Filterwerk Mann & Hummel GmbH, Ludwigsburg, Germany

[21] Appl. No.: 199,394

[22] Filed: Feb. 22, 1994

[30] Foreign Application Priority Data

Feb. 19, 1993 [DE] Germany ..... 43 05 122.7

[51] Int. Cl.[6] ..... F01M 13/04; F02M 25/06

[52] U.S. Cl. ..... 123/572; 123/573

[58] Field of Search ..... 123/572, 573, 574, 41.86; 55/498, 456; 210/315

[56] References Cited

U.S. PATENT DOCUMENTS

| | | | |
|---|---|---|---|
| 3,257,995 | 6/1966 | Schnabel . | |
| 3,754,538 | 8/1973 | Ephraim et al. | 123/574 |
| 3,978,671 | 9/1976 | Gonzales | 123/572 |
| 4,171,733 | 10/1979 | Voges | 123/572 |
| 4,502,424 | 3/1985 | Katoh et al. | 123/572 |
| 4,557,226 | 12/1985 | Mayer et al. | 123/572 |
| 4,632,682 | 12/1986 | Erdmannsdoerfer . | |
| 5,046,474 | 9/1991 | Percy | 123/572 |
| 5,154,585 | 10/1992 | Spencer . | |

FOREIGN PATENT DOCUMENTS

| | | |
|---|---|---|
| 3332324 | 3/1984 | Germany . |
| 3938919 | 12/1990 | Germany . |
| 2006329 | 5/1979 | United Kingdom . |
| 2082934 | 3/1982 | United Kingdom . |
| 2126497 | 3/1984 | United Kingdom . |

*Primary Examiner*—Henry C. Yuen
*Assistant Examiner*—M. Macy
*Attorney, Agent, or Firm*—Evenson, McKeown, Edwards & Lenahan

[57] ABSTRACT

An oil separator for the gases of the crankcase ventilating system of an internal-combustion engine has a filter element through which the breathing gases flow and from which the separated oil is returned via an oil return into the oil tank 4. The blow-by gases, from which the oil was removed, are supplied to the air intake system of the internal-combustion engine. A vacuum generator is provided which generates a specified constant vacuum for the sucking-off of the blow-by gases. In addition, an air oil removal element that separates the oil has microfibers which are made of fiber glass material.

4 Claims, 2 Drawing Sheets

OIL SEPARATOR FOR THE GASES OF THE CRANKCASE OF AN INTERNAL-COMBUSTION ENGINE

BACKGROUND AND SUMMARY OF THE INVENTION

This invention relates to an oil separator for the gases of the crankcase of an internal-combustion engine.

From German Patent Document DE-PS 39 38 919, an oil separator is known for the aerosol-containing gases ("blow-by gas") of the crankcase of an internal-combustion engine. This oil separator has an essentially rotationally symmetrical filter element, through which the blow-by gases flow from an inlet surface to an outlet surface which adjoins a clean gas space. Via an oil return, the separated oil is discharged downward to the oil sump.

In order to increase the oil separating rate and, in particular, prevent the entraining of already separated oil, a flow of the blow-by gases is forced which is directed essentially downward, the inlet surface being situated higher than the outlet surface. It was found that, when turbochargers are used on internal-combustion engines, it is necessary to achieve a very high degree of oil separation. This high degree of oil separation cannot be achieved by conventional oil separators. If there are small amounts of oil remaining in the blow-by gases, for example, in the form of oil vapor, there is the risk that this oil may deposit on the blades or on the housing of the turbocharger and over time cause oil incrustations there. This is naturally a disadvantage with respect to the operatability of the turbocharger.

An object of the invention is to provide an oil separator which is significantly improved in its efficiency with respect to the previous known oil separators and which operates by means of simple devices with as few losses as possible.

This and other objects are achieved by the present invention which provides an oil separator for blow-by gases of a crankcase ventilating system of an internal-combustion engine, comprising a filter element through which the blow-by gases flow and from which separated oil is returned via an oil return into an oil tank. The blow-by gases from which oil was removed are supplied to an air intake system of the internal-combustion engine. A vacuum generator is coupled to the filter element, the vacuum generator forming a vacuum for drawing off, i.e. aspirating, of the blow-by gases from the filter element.

The objects are also achieved by another embodiment of the invention which provides an oil separator for blow-by gases of a crankcase ventilating system of an internal-combustion engine, comprising a filter element through which the blow-by gases flow and from which separated oil is returned via an oil return into an oil tank. The blow-by gases from which oil was removed are supplied to an air intake system of the internal-combustion engine. An air oil removal element is coupled to the filter, the air oil removal element separating the oil and having microfibers made of a fiber glass material. The microfibers form at least one of a wound element and a star-folded element.

One of the significant advantages of an embodiment of the present invention is that it is not the vacuum in the intake manifold of an internal-combustion engine which is used for the ventilating of the crankcase, as was previously customary. Rather, a suitable vacuum generator is provided which generates a constant vacuum during all operating conditions of the engine.

A disadvantage of using the vacuum in the intake manifold is that the vacuum will vary according to the operating mode of the engine. Thus, for example, during idling, the intake manifold vacuum is relatively high, while, under a full load, the intake manifold vacuum is almost zero. A high vacuum also occurs during the deceleration or braking of the vehicle by the engine. However, specifically in the case of a full load, the amount of the blow-by gases to be ventilated is high and must therefore be sucked off in a reliable manner. This can be carried out reliably by means of a precisely defined vacuum so that a coking of oil on the turbocharger is prevented and the emission of the engine is reduced.

In certain other embodiments of the invention, an oil separator is provided for the removal of the oil which has microfibers which, in particular, may be made of a fiber glass material. These microfibers are formed in a winding element or a star-folded element. The air oil removal element is suitable for removing the smallest residual amounts of oil, oil vapor or similar substances from the blow-by gases. As a result, an oil coking on the turbochargers is prevented, on the one hand, and the harmful emissions of the engine are reduced, on the other hand.

According to certain embodiments, the element for the separation of oil is equipped with a perforated-plate casing which serves as a support. In addition to serving as a support, this perforated-plate casing is also suitable for an effective protection against damage to the sensitive filter material. Advantageously, the oil separating element is arranged in a con,pact container. This container is constructed as a cartridge and is exchangeable. The exchange can be carried out in a very simple manner as in the case of an oil change filter.

According to certain embodiments of the invention, the element for generating the vacuum is an ejector nozzle which is acted upon by compressed air. Such ejector nozzles have a simple construction and are very sturdy since no movable parts are required. Advantageously, the compressed air for the ejector nozzle may be taken from the compressed-air supply of the vehicle and is regulated, for example, by an adjustable throttle. Naturally, this applies only to utility vehicles which have their own compressed-air supply in the vehicle. However, specifically in these vehicles, the amount of crankcase blow-by gases to be sucked off is high and an effective oil removal from these blow-by gases is therefore required.

For avoiding an excess pressure in the crankcase, a return valve is arranged in the line for carrying off the gases from which the oil was removed, according to an advantageous embodiment of the invention.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
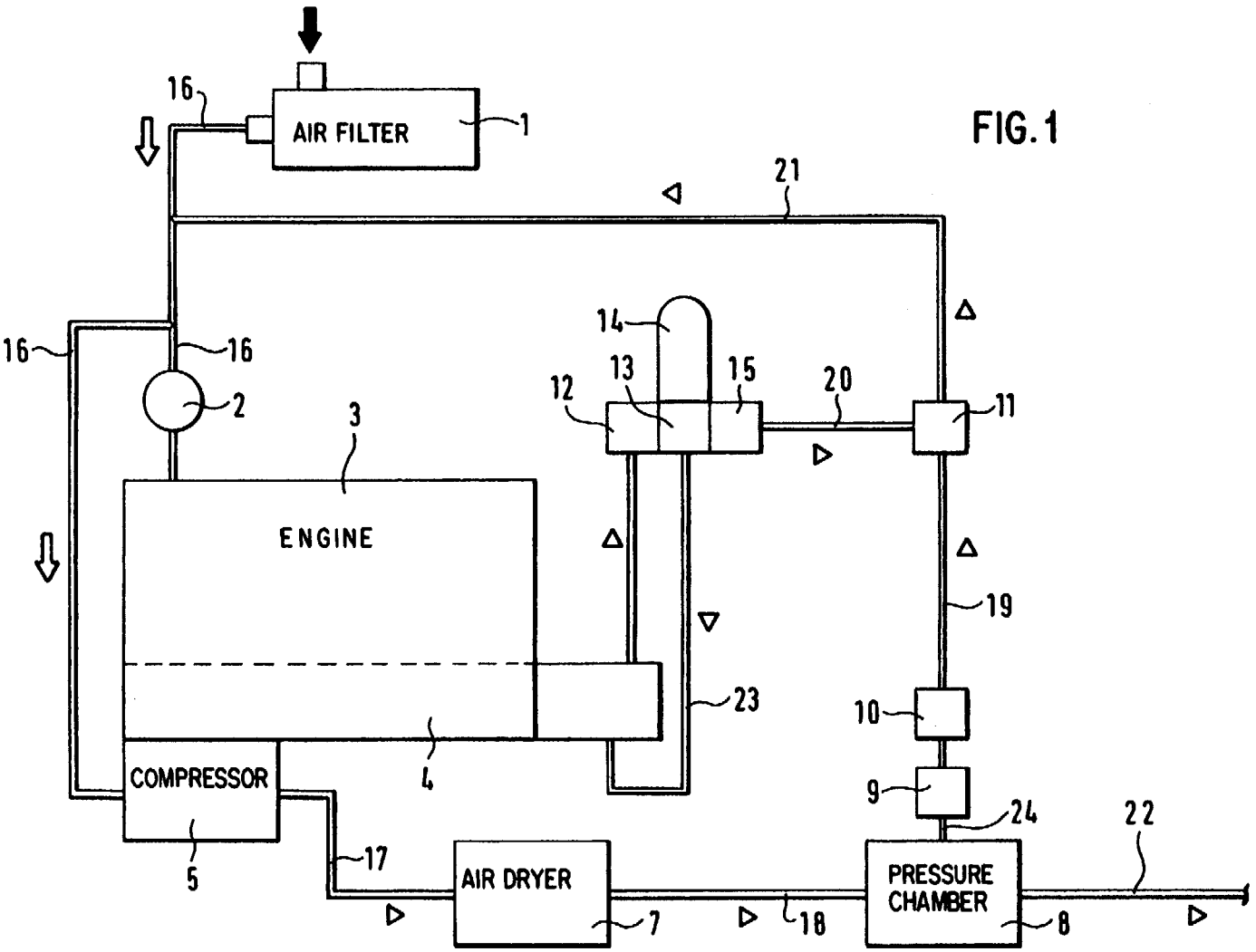
FIG. 1 schematically illustrates an internal-combustion engine with a crankcase gas intake constructed in accordance with an embodiment of the present invention.

FIG. 1 is a schematic representation of an internal-combustion engine with an intake for crankcase gases. The internal-combustion engine 3 has a line leading from the crankcase 4 in the upward direction through which crankcase gases flow into a control valve 12. The control valve 12 provides a constant vacuum in the crankcase 4 and comprises, for example, a spring-loaded membrane which closes the line in the event of an excessive vacuum. From the control valve 12, the crankcase gases arrive, via a filter head 13, in an air oil removal element 14. This air oil removal element 14 operates according to the "coalescer" principle. Microfiber glass layers separate oil droplets from the crankcase gases and return them in large drops into the oil circulating system via the line 23.

The effect of the separating process reaches into the submicron range. Thus, oil is effectively prevented from entering the intake tract of the engine. An air oil removal element is described in detail, for example, in German Patent Document DE-OS 33 32 324, and U.S. Pat. No. 4,632,682.

The blow-by gases, from which the oil has been removed, are provided to a return valve 15 and to a return line 21 through an ejector nozzle 11. The blow-by gases are supplied by the return line 21 to the intake air side of the engine 3. Via the compressed-air supply system of the vehicle, the ejector nozzle 11 is acted upon by compressed air via the line 19. The compressed air is generated by a compressor 5, for example, a screw-type or piston-type compressor. The compressed air of the vehicle is supplied via a line 17 to an air dryer 7 and from there, via the line 18, is stored in the pressure chamber 8. From the pressure chamber 8, the compressed air is supplied via the compressed air line 22, for example, to the braking system of the vehicle. Via a branch-off 24, a portion of the compressed air is fed via a solenoid 9 and a throttle 10 to the line 19. The solenoid 9 is opened up when the engine 3 is started and is closed when the engine 3 is turned off, so that the compressed air is not consumed unnecessarily. The throttle 10 is used for adjusting the vacuum required for drawing off the crankcase gases.

The gases from which the oil was removed and which are supplied to the air intake system of the internal-combustion engine via the line 21, arrive in the clean air line 16. On the inlet side, this clean air line 16 is provided with an air filter 1 which takes in fresh air in a customary manner. A turbocharger 2 is integrated in the clean air line 16, this turbocharger 2 operating in the customary manner for an internal-combustion engine. In addition, the clean air line 16 is provided with a branch-off which leads to the compressor 5 so that the compressed-air supply of the vehicle also operates with clean air.

The vacuum, which is generated by means of the ejector nozzle 11, is dimensioned such that it is sufficient for overcoming the flow resistance of the air oil removal element 14 and a specified constant vacuum is achieved in the crankcase.

Figure 2:
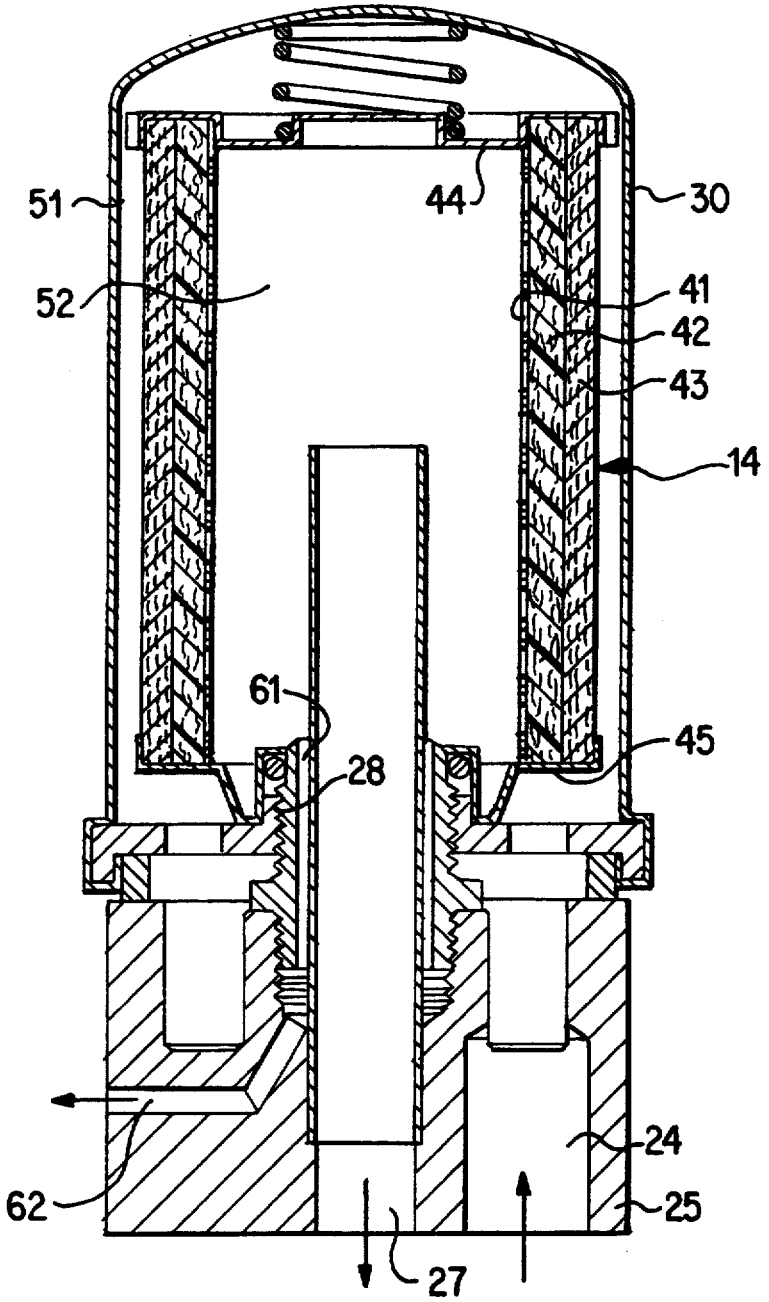
FIG. 2 is a cross-sectional view of an air oil removal element that may be used in the present invention.

An air oil removal device that can be used in the present invention is illustrated in FIG. 2, and is described in detail in U.S. Pat. No. 4,632,682, herein incorporated by reference. The air oil removal device has a separator head 25, with an inlet 26 and an outlet 27. Attached to the separator head 25 by a threaded connection 28 is a cartridge 30 that contains an air oil removal element 14. This air oil removal element 14 has a cylindrical perforated sleeve 41, an inner separator member 42 of polyester fleece surrounding the supporting sleeve 41, an outer separator member 43 in the form of a wound or star-folded element made of microfibers of a fiberglass material, an upper end disc 44, and a lower end disc 45. In operation, the raw air enters through the inlet bore 26 and passes into a raw air space 51 in the cartridge 30. The air then flows radially inwardly through the outer separator member 43 and the inner separator number 42, where the minute droplets of oil entrained by the raw air are trapped and coalesced into larger oil droplets which flow downwardly towards the lower end disc 45. The clean air leaves the clean air space 52 through the outlet bore 27. The oil which collects in the bottom of the air oil removal element 14 flows into an annular gap 61 and, via a drain channel 62, into a collecting receptacle (not shown in FIG. 2). The air oil removal element 14 can be easily replaced since it is arranged in the cartridge 30 which forms an exchangeable receptacle.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An oil separator for blow-by gases of a crankcase ventilating system of an internal-combustion engine, comprising:

a filter through which the blow-by gases flow and from which separated oil is returned via an oil return into an oil reservoir, the blow-by gases from which oil was removed being supplied to an air intake system of the internal-combustion engine; said filter comprising an air oil removing element which separates entrained oil from said blow-by-gases said air oil removing element comprising a wound or star-folded element formed of microfibers of fiberglass material;

a vacuum generator coupled to the filter element, the vacuum generator comprising an ejector nozzle acted on by compressed air supplied from a compressed air source for an air braking system, said vacuum generator forming a vacuum for aspirating the blow-by gases from the filter element; and an adjustable throttle which controls the pressure of compressed air supplied from said compressed air source to said ejector nozzle.

2. An oil separator according to claim 1, wherein the air oil removal element has at least one perforated-plate casing that provides support to the air oil removal element.

3. An oil separator according to claim 1, further comprising an exchangeable receptacle in which the air oil removal element is arranged.

4. An oil separator according to claim 1, further comprising a line for discharge of the gases from which the oil was removed, and a return valve in said line.

* * * * *